United States Patent [19]

O'Neill

[11] Patent Number: 5,074,459

[45] Date of Patent: Dec. 24, 1991

[54] MAILING ENVELOPE

[76] Inventor: Keith P. O'Neill, 2631 Walter, Flint, Mich. 48504

[21] Appl. No.: 501,353

[22] Filed: Mar. 28, 1990

Related U.S. Application Data

[63] Continuation of Ser. No. 6,423, Jan. 23, 1987, abandoned.

[51] Int. Cl.[5] ..... B65D 27/04; B65D 27/08

[52] U.S. Cl. ..... 229/71; 229/72

[58] Field of Search ..... 229/71, 72, 73

[56] References Cited

U.S. PATENT DOCUMENTS

| | | | |
|---|---|---|---|
| 36,393 | 9/1862 | Brown | 229/71 |
| 1,297,778 | 3/1919 | Banks et al. | 229/72 |
| 1,772,280 | 8/1930 | Fraser | 229/72 |
| 1,810,649 | 1/1931 | Elliott | 229/71 |
| 2,101,342 | 12/1937 | Pflanze | 229/72 |
| 2,317,497 | 4/1943 | Thompson | 229/72 |
| 2,794,590 | 6/1957 | Sills, Jr. | 229/71 |
| 3,084,846 | 4/1963 | Clegg . | |
| 3,111,257 | 11/1963 | Peach . | |
| 3,111,258 | 11/1963 | Perlstein . | |
| 3,143,279 | 8/1964 | Black . | |
| 3,158,313 | 11/1964 | Hubbard | 229/71 |
| 3,227,360 | 1/1966 | Krueger . | |
| 3,250,456 | 5/1966 | Schuessler . | |
| 3,255,952 | 6/1966 | Black . | |
| 3,315,878 | 4/1967 | Hiersteiner | 229/72 |
| 3,321,127 | 5/1967 | Miller | 229/71 |
| 3,522,908 | 8/1970 | Carrigan | 229/71 |
| 3,618,284 | 11/1971 | Gendron . | |
| 3,722,787 | 4/1974 | Wiessner . | |
| 3,843,042 | 10/1974 | Mayne . | |
| 4,089,418 | 5/1978 | Yale . | |
| 4,089,419 | 5/1978 | Yale . | |
| 4,204,600 | 5/1980 | Pritchard | 229/71 |
| 4,245,775 | 1/1981 | Conn . | |
| 4,524,903 | 6/1985 | Vath . | |
| 4,565,317 | 1/1986 | Kranz . | |
| 4,585,160 | 4/1986 | Fiske, II . | |

OTHER PUBLICATIONS

Article from the PennyStock News, dated May 2, 1986.

*Primary Examiner*—Stephen Marcus
*Assistant Examiner*—Jes F. Pascua
*Attorney, Agent, or Firm*—Gifford, Groh, Sprinkle, Patmore and Anderson

[57] ABSTRACT

An improved mailing envelope has a business card size window cut in the upper left hand corner of the envelope where the return address normally appears. A sheet of clear plastic is folded and glued to form a pocket which, in turn, is glued to the interior of the envelope over the window. A busness card is inserted into the pocket so that it is visible through the window to serve as a return address on the envelope.

6 Claims, No Drawings

MAILING ENVELOPE

This is a continuation of copending application Ser. No. 07/006,423 filed on Jan. 23, 1987, abandoned.

BACKGROUND OF THE INVENTION

I. Field of the Invention

This invention relates to mailing envelopes and, in particular, to a mailing envelope having a novel return address system comprising a window and a pocket adapted to receive a business card, so that a business card is sent to the addressee.

II. Description of the Prior Art

Numerous systems have previously been employed for placing a return address in the upper left hand corner of an envelope. Most commonly, the return address is simply written or typed in this particular area of the envelope, which may or may not be provided with blank lines. This method is both tedious and time consuming. Alternatively, envelopes can be purchased preprinted with a return address, but these are expensive.

Another system for including return addresses on envelopes comprises a series of gummed labels having the return address preprinted thereon. While such systems are considerably more efficient than individually writing the return address, they still suffer certain drawbacks. For example, if they become inadvertently moistened an entire stack can become ruined. Also, they generally must be purchased in rather large quantities, many of which will be wasted if the address changes.

Finally, other systems utilize windows cut in the envelope so that a mailing address and/or a return address can be viewed directly from the enclosed printed matter. This system is frequently used for mailing invoices or bills and also has its disadvantages. If the enclosed matter is not printed in exactly the right location and if the printed matter is not carefully folded to place the printed address in the exact location, the address may not be visible through the window.

SUMMARY OF THE PRESENT INVENTION

Some of the disadvantages of the mailing systems previously known in the art are overcome by the present mailing device. The envelope of the present invention is conventional in many respects, having front and rear panels and a gummed flap to seal the opening to the interior. However, in the upper left hand corner of the envelope is cut a rectangular window having dimensions approximately corresponding to those of a standard business card. A pocket panel or flap is glued along three sides to the inside of the front panel of the envelope behind the window. The pocket panel is not glued along the side closest to the opening of the envelope so that a pocket is formed between the pocket panel and the front panel of the envelope. A standard business card can be inserted into the pocket so that information contained on the business card is visible through the window to constitute a return address.

In another embodiment a transparent panel separates the business card and the front panel of the envelope so that the business card is not directly exposed, yet remains visible. In this embodiment a single sheet of transparent plastic can be folded to form both the transparent window panel and the pocket panel.

DETAILED DESCRIPTION OF THE PREFERRED EMBODIMENT

The return address envelope of the present invention comprises a conventional envelope having a front panel, a rear panel and a closing flap. The envelope is conventional in most respects and can be manufactured in any manner known in the art, so long as it has a front panel and a rear panel joined along three sides to define an opening through which letters or other matter can be inserted.

A rectangular window is cut in the upper left hand corner of the front panel of the envelope. The window has a pair of short sides approximately two inches long parallel to the short sides of the envelope, and a pair of long sides approximately three and one half inches long parallel to the long sides of the envelope. These window dimensions are substantially those of a standard business card. Although the window of the preferred embodiment is rectangular, it is to be understood that windows of other shapes such as squares, ovals, circles and the like may be employed so long as the content of the business card remains substantially visible through the window.

A pocket is formed between the interior face of front panel and a pocket panel which is glued to the interior face of the front panel. The pocket panel is glued to the front panel over the window along both short sides and the bottom long side of the window to form the pocket into which the business card can be slidably inserted. The pocket panel is dimensioned slightly larger than the window so that a perimeter of the pocket panel can engage the interior surface of the front panel.

In a first embodiment of the present invention the window is dimensioned slightly smaller than the business card so that a ledge portion of the front panel provides a surface against which the business card can abut around the perimeter of the window. The ledge prevents the business card from falling completely through the window and out of the envelope.

A second preferred embodiment of the present invention includes a transparent panel disposed over the window on the interior face of the front panel. The transparent panel, like the ledge, prevents the business card from falling out of the pocket and from becoming soiled by the elements or the mailing process. In this embodiment the window can be the full dimension of the business card, as no ledge is required.

Preferably, the transparent member and the pocket panel are both formed from a single rectangular sheet of clear plastic which is folded in two. The clear plastic sheet when folded, should be dimensioned slightly larger than both the window and the business card so that a perimeter of the transparent panel portion of the sheet can be glued to the interior face of the front panel.

The pocket panel portion of the sheet is glued to the transparent panel portion along the two short sides which are opposed to one another, leaving an opening to form the pocket. Preferably, the two portions of the single plastic sheet which comprise the transparent panel and the pocket panel are of slightly unequal size so that a portion of the transparent panel rises above the upper edge of the pocket panel. This facilitates insertion of the business card into the pocket.

Although the term "glued" has been used to describe the attachment of one portion to another, the term should be broadly interpreted to encompass heat sealing, bonding or any other means by which the elements can be attached one to the other.

Having thus described the structural features of the present invention, its operation can be easily understood. When an individual wishes to mail a letter or the like, he or she simply opens the envelope by lifting the flap to reveal the opening. Just inside the envelope near the opening is the top opening of the pocket. The individual simply slides his or her business card into the pocket so that the information contained thereon is visible to the window in the front panel of the envelope. The letter or other material is then added to the envelope and the flap is sealed.

Many advantages of the return address envelope of the present invention will be obvious to those skilled in the art. For example, unlike many preprinted envelopes, the return address is personal and individualized so that the addressee can identify immediately the individual from whom mail is received, rather than just the company. In addition, business cards frequently have a logo or name of the company which will also be visible through the window and can serve as low cost advertising. Finally, and perhaps most importantly, the improved envelope provides a means by which the sender can conveniently send a business card to the addressee. The addressee need only remove the busines card from the pocket and save it for future use.

The foregoing detailed description of the preferred embodiment has been given for clearness of understanding only and no unnecessary limitations should be understood therefrom. Some modifications will be obvious to those skilled in the art to which the invention pertains without deviation from the spirit of the invention as defined by the scope of the appended claims.

I claim:

1. A mailing device comprising in combination:

a conventional business card bearing thereon name and address information;

an envelope having a front panel with an interior face and an exterior face, a rear panel attached to the front panel to define an interior, and a flap attached to said front panel at an edge, said flap possessing an adhesive for engagement with said rear panel, wherein said front panel includes a window disposed in the upper left-hand corner thereof, located in a position corresponding to the conventional position for return address information; and a pocket panel attached to the interior face of said front panel across said window to form a pocket between said front panel and said pocket panel, said pocket having a top opening and having a bottom edge sealingly attached to said front panel and being dimensioned to reversibly and slidably receive said business card;

said bottom edge of said pocket being formed by a single folded transparent sheet, being affixed a predetermined distance, said distance being equal to the width of said business card;

whereby said business card is held in a predetermined position to be viewed through said window, wherein adhesion of said flap to said rear panel of said envelope simultaneously seals said envelope interior, closes said top opening of said pocket and retains said business card in said pocket; and wherein said window is dimensioned so that said information on said business card is substantially visible from the exterior face of said front panel to serve as a return address when said business card is received in said pocket; and said business card is intended to be removed and retained by the recipient of the mail envelope.

2. The mailing device as defined in claim 1 and comprising a transparent pocket panel, pre-sized and preglued into the pocket shape, adhered to the interior face of the front panel, across said window, within said pocket so that the business card is slidably received between said pocket and the transparent panel.

3. The mailing device as defined in claim 2 wherein said transparent panel is clear plastic.

4. The mailing device as defined in claim 1 wherein said pocket panel is generally rectangular and is adhered to said front panel along a bottom long side and two short sides to form the pocket so that a ledge is defined in said front panel between a perimeter of said window and the bottom and sides of said pocket.

5. The mailing device as defined in claim 1 wherein the envelope and the window are both substantially rectangular having parallel long sides and wherein the long sides of the envelope are parallel to the long sides of the window.

6. The mailing device as defined in claim 5 wherein the window is approximately 2 inches by 3½ inches.

* * * * *